US007891629B2

(12) United States Patent
Moyers

(10) Patent No.: US 7,891,629 B2
(45) Date of Patent: Feb. 22, 2011

(54) ROTATABLE CHAIR SUPPORT

(75) Inventor: Brent Moyers, Easton, CT (US)

(73) Assignee: Labrador Development LLC, Easton, CT (US)

( * ) Notice: Subject to any disclaimer, the term of this patent is extended or adjusted under 35 U.S.C. 154(b) by 526 days.

(21) Appl. No.: 11/933,689

(22) Filed: Nov. 1, 2007

(65) Prior Publication Data

US 2008/0265642 A1 Oct. 30, 2008

Related U.S. Application Data

(60) Provisional application No. 60/863,981, filed on Nov. 2, 2006.

(51) Int. Cl.
*A47B 91/00* (2006.01)

(52) U.S. Cl. ..... 248/349.1; 248/425; 297/344.21; 297/344.26

(58) Field of Classification Search ..... 248/349.1, 248/289.11, 415, 425; 297/344.21, 344.26; 296/64, 65.01, 65.13, 65.14
See application file for complete search history.

(56) References Cited

U.S. PATENT DOCUMENTS

| | | | | |
|---|---|---|---|---|
| 6,161,806 | A * | 12/2000 | Crosson | 248/118.3 |
| 6,824,219 | B2 * | 11/2004 | Ruckstadter | 297/423.27 |
| 6,896,330 | B1 * | 5/2005 | Yu | 297/344.21 |
| 6,997,512 | B1 * | 2/2006 | Yu | 297/344.26 |
| 7,328,952 | B2 * | 2/2008 | Guerrini | 297/344.21 |
| 2002/0023995 | A1 * | 2/2002 | Yoshida et al. | 248/425 |
| 2004/0195886 | A1 * | 10/2004 | Beatty et al. | 297/344.22 |
| 2006/0124818 | A1 * | 6/2006 | Wai | 248/349.1 |
| 2007/0007808 | A1 * | 1/2007 | van Deursen | 297/344.21 |
| 2007/0241601 | A1 * | 10/2007 | Guerrini | 297/344.21 |

* cited by examiner

*Primary Examiner*—A. Joseph Wujciak, III
(74) *Attorney, Agent, or Firm*—Finch & Maloney PLLC

(57) ABSTRACT

The disclosure relates to a rotatable support for a beach chair that has a low profile, can be lightweight, is durable and may include a bearing that is resistant to sand. The support is easy to use, store and transport. It may be easily attached and removed from a beach chair.

16 Claims, 6 Drawing Sheets

ROTATABLE CHAIR SUPPORT

RELATED APPLICATION

This application claims benefit of U.S. Provisional Patent Application Ser. No. 60/863,981 titled "ROTATABLE CHAIR SUPPORT," filed Nov. 2, 2006 and which is hereby incorporated by reference herein.

BACKGROUND

1. Field of Invention

The invention relates to rotatable furniture supports and, in particular, to rotatable chair supports designed to withstand outdoor environments.

2. Discussion of Related Art

One of the pleasures of going to the beach is sitting in a comfortable chair and soaking up the sun. Many beachgoers will spend hours reading, talking or just relaxing while enjoying the warmth of the sun's rays. To maximize exposure to the sun and to receive a balanced exposure, beachgoers often adjust the position of their chairs to assure constant, even sun exposure. This can involve frequent turning and shifting of the chair.

In addition to chairs made specifically for beach use, there are products that provide for easier rotation of the chair with respect to the sun's rays. For example, the chairs may be mounted on a support that allows the chair to be rotated without requiring lifting of the chair. Some of these chair supports are motorized and some are passive devices that allow the beachgoer to rotate the chair using his or her own body. However, these chair supports may be, for example, heavy, bulky, unstable, subject to contamination, or otherwise lacking in performance in the environment in which they are most frequently used.

SUMMARY OF INVENTION

In one aspect a rotatable chair support is disclosed, the chair support comprising a circular base having an upper surface and a lower surface, the upper surface defining a first raceway, a cover including a second raceway complementary to the first raceway, a plurality of rolling elements retained in a space formed by the first and second raceways, a clamp rotatably securing the cover to the base, and a cap removably attached to the lower surface of the base, the cap forming a collection cavity between the cap and the base.

In another aspect, a rotatable chair support is provided, the support comprising a circular base having an upper surface and a lower surface, the upper surface defining a first raceway wherein the raceway includes a plurality of holes, a cover including a second raceway complementary to the first raceway, a plurality of rolling elements retained in a space formed by the first and second raceways, and a clamp rotatably securing the cover to the base.

In another aspect, a method of connecting a chair to a rotatable support is provided, the method comprising sliding a first substantially horizontal chair rail laterally into a first chair clip associated with the support, pressing a second substantially horizontal chair rail vertically into a second chair clip associated with the support to removably connect the chair to the support, and rotating the chair on the support.

The subject matter of this application may involve, in some cases, interrelated products, alternative solutions to a particular problem, and/or a plurality of different uses of a single system or article.

DETAILED DESCRIPTION

Figure 1:
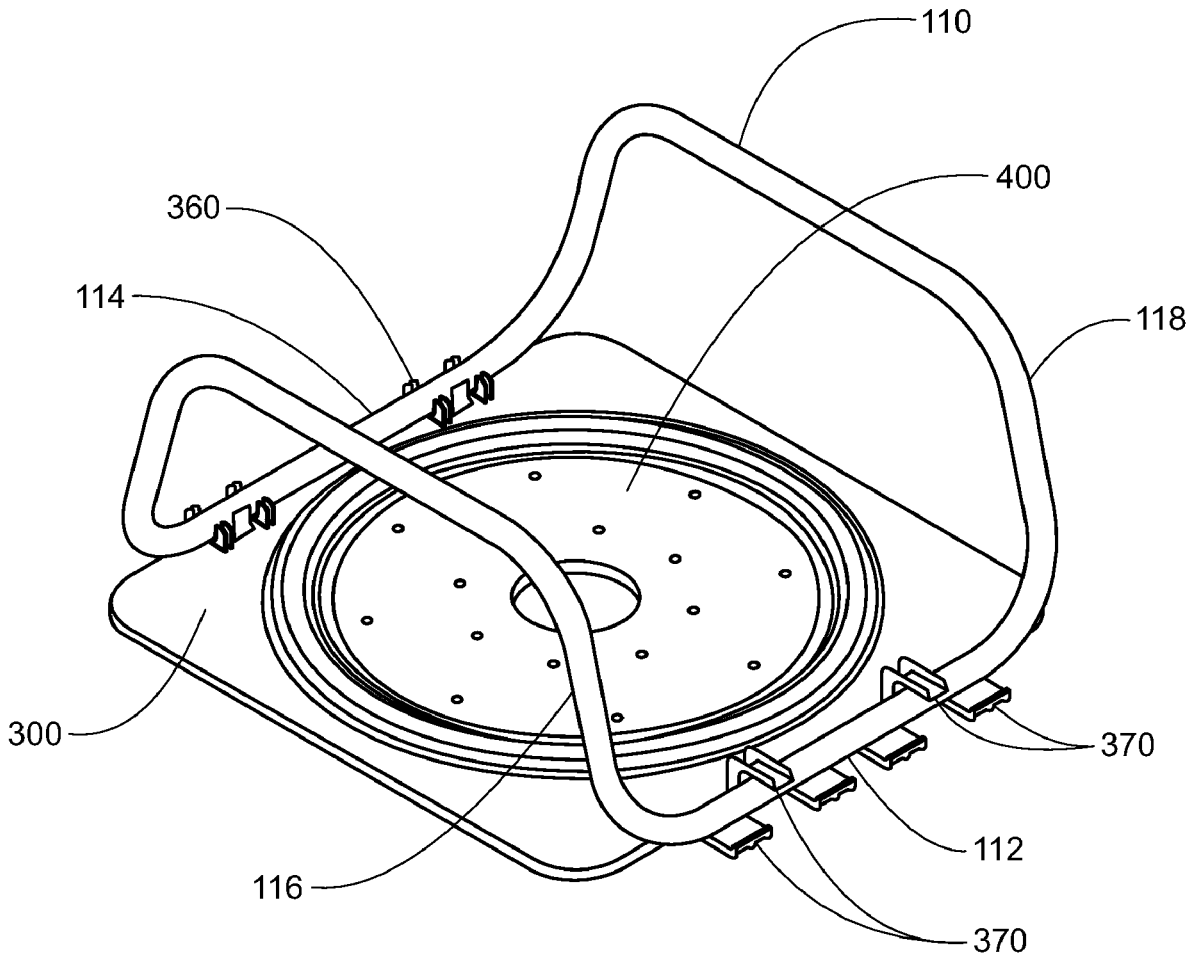
FIG. 1 is a schematic of one embodiment of the invention illustrating the legs of a beach chair attached to a rotatable support.

Beach chairs continue to evolve and have become lighter, compact and more comfortable. This results in a chair that is easier to carry and store while still providing a comfortable day at the beach. In one aspect of the invention, a support for a beach chair is disclosed that provides a light, transportable support that can allow for easy rotational movement of an attached chair. It may be used with a variety of beach chairs and, in one embodiment, can be securely attached to any beach chair having two horizontal chair rails. In the absence of a chair support, these chair rails would typically be in contact with the ground, supporting the chair.

In some embodiments, the chair support may include a rotatable bearing that allows an attached chair to rotate while the base of the support remains stationary with respect to the ground. Preferably, the support provides lateral support to the chair so that the chair is less likely to tip when the center of gravity is moved off center. Furthermore, the chair support may exhibit a low profile, for example, less than 3 inches, less than 2.5 inches, or less than 2 inches in total height. This low profile may aid in lowering the center of gravity when the chair and support are in use, resulting in, for example, a more stable platform, a more comfortable position for the user, and easier storage and transportation. In some cases, the user may feel no higher off the ground than he or she would be without the use of the support. Thus, the user may be able to rotate the chair without feeling that the chair has been raised to an unnatural or uncomfortable height. The support may include one or more components that are reinforced to provide strength and stiffness while still reducing the amount of material to reduce weight. The support components may be, for example, ribbed, spoked or honeycombed to improve stiffness while incorporating a lightweight structure. For instance, the support structure, exclusive of a chair to which it may be attached, may weigh less than 7 lbs.

One of the problems encountered by mechanical mechanisms at the beach is the intrusion of sand. Beach chairs and rotatable supports are no exception. Designers have tried to keep mechanisms free of sand by using various seals and bushings, but these designs have largely been incapable of excluding all sand from the mechanism. In particular, ball bearings are susceptible to sand intrusion. While these bearings may be able to function with some level of sand intrusion, the wear on the bearing will invariably increase and the smoothness of rotation may be affected. Eventually, the bearing may become noisy and difficult to rotate and may require replacement.

In one embodiment, a rotational ball bearing is used to provide rotational movement for the chair. To comfortably support a user, the bearing may have a wide diameter, for example, greater than 10, greater than 15 or greater than 20 inches. A bearing of this diameter may present many opportunities for the intrusion of sand, and this may be of particular concern when lightweight materials are used to produce the chair support. The bearing may be designed to expel sand particles that may enter the bearing. Instead of trying to completely seal the bearing to prevent contamination from sand particles, one or more of the bearing raceways may include a series of holes or slits that may be large enough to allow most sand particles to pass through while still being small enough to retain the bearing's rolling elements and to not unduly interfere with the movement of the rolling elements when the device is rotated. The holes may be in a lower raceway that supports the rolling elements when the support is in an upright position. In this manner, any sand particles may pass through the holes and out of the bearing by, for example, gravity, movement of the rolling elements, or a combination of both.

The raceway may be in communication with the external environment but in some embodiments may be isolated from the external environment. For example, the support may include a collection space between the raceway and the external environment. This collection space may be partially or totally sealed from the external environment and may help in preventing direct contact between the lower surface of the bearing raceway and the surface on which the support rests. The collection space may provide an area for sand to collect that may have fallen through the raceway holes. The collection space may include a removable cover allowing a user to empty the space of any contaminants, such as sand, that may have entered the collection space.

The support may be made out of a material or combination of materials that provides for a low weight device while still providing adequate support and durability. Preferably, the materials provide adequate stiffness so that the support does not deform or bend when the weight of the user shifts from side to side. For instance, the device may be made out of a polymeric material, such as, for example, polyethylene, polypropylene, polycarbonate, polystyrene, ABS, PET, or any combination of polymers. Different components of the support may be made out of different or identical materials. In some embodiments, the support, without a chair attached, may weigh less than 7 lbs, less than 6 lbs, less than 5 lbs, less than 4 lbs or less than 3 lbs. Components of the device may be made using techniques known to those skilled in the art, such as by molding or pressing. For instance, the support, or its components, may be made by injection molding, vacuum forming, pressing, extruding and/or machining. A chosen method may often depend on, for example, the specific type of material as well as the size of the part and the number of pieces to be made. Different components of the support may be manufactured using different methods.

Support components may be made from polymers that include additives such as fillers, reinforcing materials, pigments, conductive particles and/or UV stabilizers. For example, the use of a conductive polymer may help to reduce build-up of static charge in the device or in a chair supported by the device. UV resistant additives may improve the life of a component that is exposed to sunlight for long periods of time. In some embodiments, the polymeric materials, including the rolling elements, may contain micro-bubbles of air or nitrogen, helping to reduce weight while retaining rigidity.

The rolling elements of the bearing may be, for example, rods, cones or balls. Generally, balls are preferred over other rolling elements. The balls may be made of, for example, metal, ceramic or polymeric materials. Polymeric balls may be preferred as they are available in many sizes at low cost and may be lighter than other materials providing for a light weight support. For instance, 9/16 inch polyethylene balls have been shown to form a useful ball bearing support. Furthermore, polymeric balls may not require a lubricant and are unlikely to crack or fracture in the presence of sand particles. They also may be of a low durometer. This reduced hardness may allow the balls to roll more smoothly in the presence of sand particles. Other materials of greater hardness may grind or stop rolling in the presence of sand particles. In addition, polymeric balls typically may be quieter and will be less of distraction to the user when compared to metallic or ceramic balls. Balls may be solid, hollow, or interspersed with microvoids.

Preferably, a chair attached to a rotatable support is removably attached to the support. This may allow for the chair and the support to be separated for easier transportation and/or storage. In some embodiments, the chair may be secured to the support in a manner that allows the two to be moved as a single unit. Therefore, if the beachgoer is set up on the beach, the support can be moved simply by lifting up the chair and moving the combined units.

In some embodiments the support may be constructed and arranged to receive the horizontal rails that are often found on the lower portion of beach chairs. For example, the embodiment shown in FIG. 1 includes chair legs 110 that include horizontal rails 112 and 114. These horizontal rails typically run parallel to each other either from back to front or side to side. The rails may form part of a "U-shaped" structure that includes two vertical legs 116 and 118. A rotatable support may include one or more receiving clips for retaining the horizontal rails of the chair. The clips may be of a resilient material that allows tubular shaped rails to snap securely into place while still allowing the rails to be removed from the support when desired. In the embodiment shown in FIG. 1, a first rail slides horizontally into a first clip 370 and subsequently the chair can be rotated downward on that rail to allow the second rail to slide vertically into a second clip 360. In this case, the first clip may be open in a lateral direction and the second clip may be open in a vertical direction, approximately 90 degrees from the orientation of the first clip.

In some embodiments, the rails of the beach chair are attached to the rotatable support at a position below the top level of the support. Specifically, the bottom edge of the rails may be below the level of the top edge of the support when the chair and support are joined together. This may help to lower the center of gravity of the support/chair/user combination which may in turn provide for a more stable platform.

Figure 2:
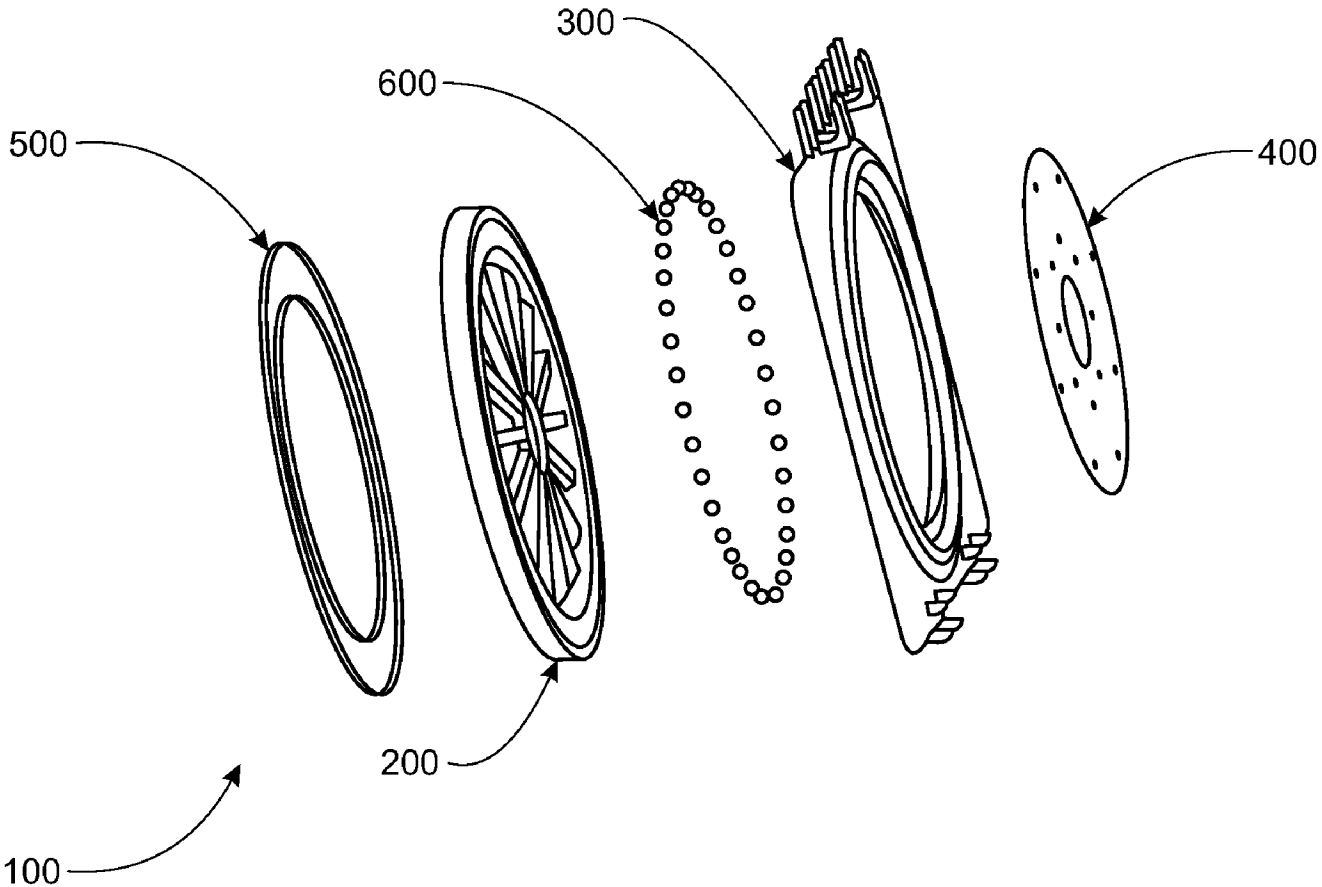
FIG. 2 provides an exploded view of one embodiment of a beach chair support.

FIG. 2 provides an exploded view of one embodiment of the invention. Rotatable support 100 includes base 200, cover 300, clamp plate 400, bottom cap 500 and rolling elements 600. Components may be secured together by attaching clamp plate 400 to base 200 with screws or other fasteners. Bottom cap 500 may snap into place or may be secured with fasteners, preferably removable fasteners.

Figure 3:
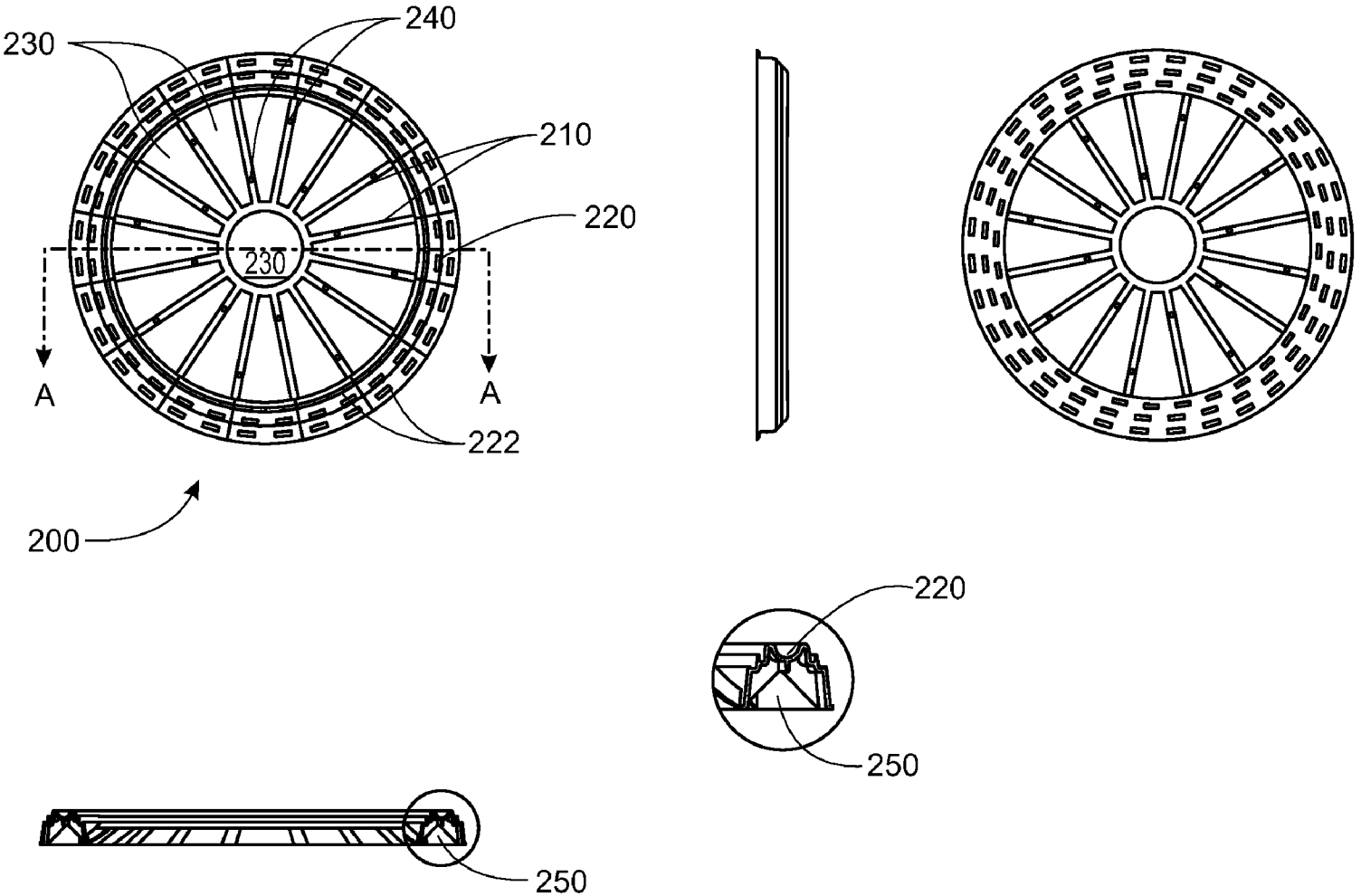
FIG. 3 provides a profile view of the base of the support shown in FIG. 2.

FIG. 3 provides a profile view of base 200 and a cross-section view in detail B. Base 200 is made out of a lightweight honeycomb plastic such as ABS. Spokes 210 add rigidity and strength while keeping the weight of the base low. Opening 230 passes completely through the base. Spaces between ribs 210 also pass completely through the base providing for weight reduction. Screw holes 240 can receive self-tapping screws that pass through the clamp base 400, cover 300 and into base 200. Circular raceway 220 is substantially convex and may be sized to loosely retain rolling elements. The raceway may be located substantially near the perimeter of the base. Raceway 220 may include one or more passages 222 that provide communication between the raceway and collection space 250. The passages may be series of slits substantially aligned in the direction of the raceway. In this manner, sand can exit the raceway but the orientation of the slits may not substantially affect the rigidity of the base component. In addition, the rolling elements can pass easily over the slits without substantially interfering with the movement of the elements. Slits may be, for example, 1 mm, 2 mm, 3 mm, or more in width.

Figure 4:
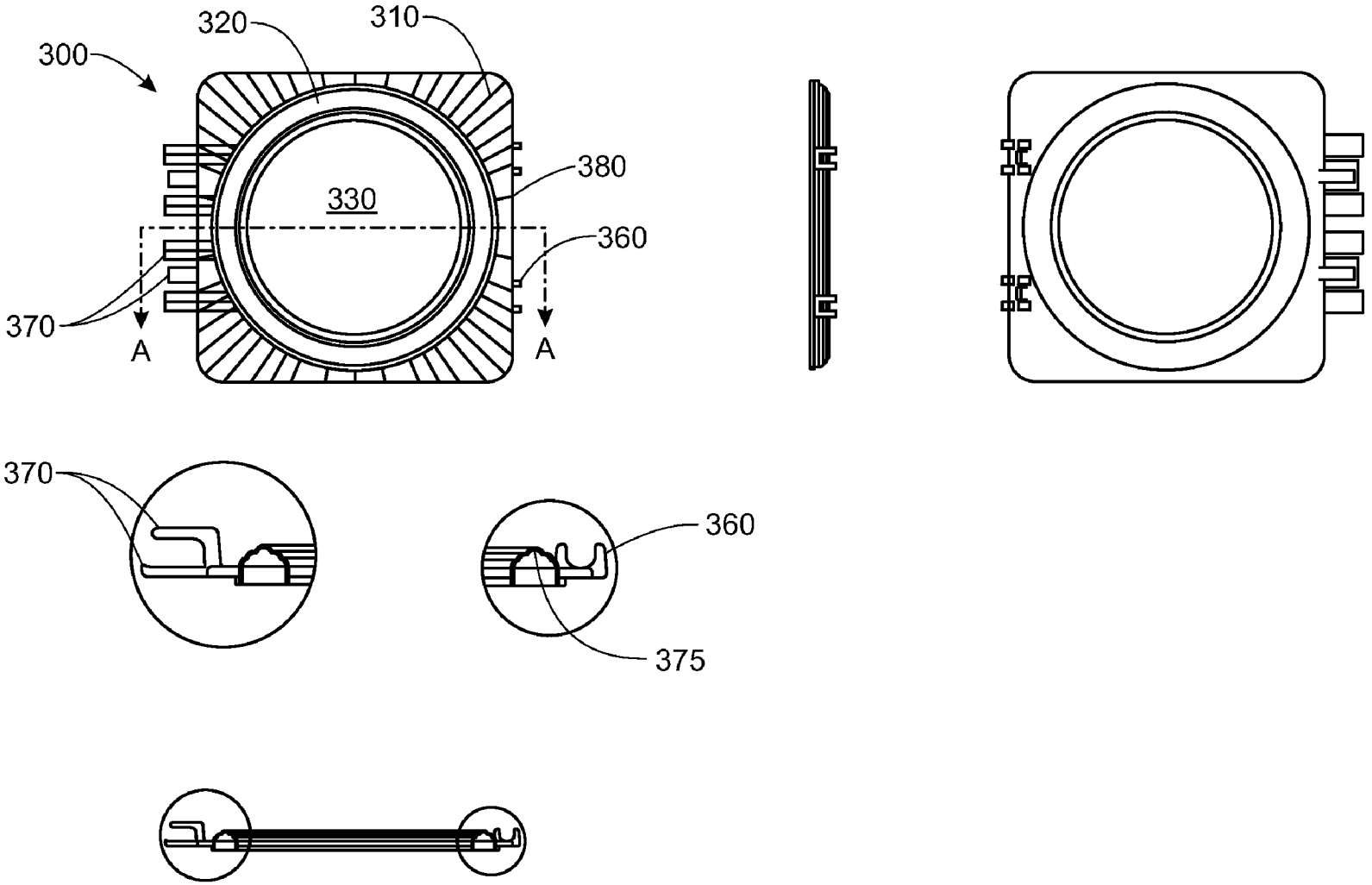
FIG. 4 provides a profile view of the cover of the support shown in FIG. 2.

FIG. 4 provides profile and cross-sectional views of support cover 300. Support cover 300 may be made of a material similar or identical to that of base 200. Cover 300 may include upper raceway 320 that, when mated with base 200, forms an enclosed raceway to retain the rolling elements. This bearing allows cover 300 to rotate in relation to base 200. This means that a chair fixed to the cover can rotate in relation to the base and, therefore, in relation to the ground. The perimeter of cover 300 may be any shape, but in the embodiment illustrated is substantially square with rounded corners. The diameter of the cover may be substantially the same as the footprint of a chair with which it is designed to be used with. For example, the cover may have a diameter of greater than 15 inches or greater than 20 inches. In some embodiments, the diameter is in the range of 20 inches to 25 inches and preferably about 21 to 23 inches. At this size and shape, the support may provide good lateral support and stability while not interfering with movement around the chair. This size may also provide for ease of carrying and storage.

Ribs 310 may include areas of added thickness and may provide for improved rigidity. Lip 380 is of a small enough diameter to retain clamp base 400 without allowing clamp base 400 to pass through opening 330. Lip 380 is preferably of a material, or coated with a material, that allows it to rotate with little friction when in contact with clamp base 400.

Cover 300 may also include devices for engaging and/or retaining a chair. For example, clips 360 and 370 may be used to retain a chair that includes horizontal rails. One horizontal rail may be slipped into plurality separated lateral clips 370, wherein the lateral clips are offset from each other. The other horizontal rail may be pressed into vertically u-shaped oriented clip 360. The upper portion of one or both sides of clip 360 may curve in toward the central portion of the clip to provide snap retention of the rail once it is pressed into place. The clip may be of a resilient material that allows clip 360 to expand outwardly when pressure is applied from the horizontal chair rail. The substantially tubular shape of the chair rail may help in securely retaining the rail in the clip. Alternative methods of attachment may be used, particularly with chairs that may not include horizontal rails.

Bottom cap 500 may be attachable to a portion of the support such as base 200. Bottom cap 500 may be permanently attached, but preferably the cap is removable and replaceable by the user. When joined with base 200, the cap may form a collection space that may retain sand particles that pass through passages 222 in base 200. Sand particles may also enter the collection space by passing through the junction between bottom cap 500 and base 200. Sand particles and any other debris that may enter the collection space can be released by removing bottom cap 500 and allowing any retained particles to drop out. In embodiments where no lubricant is used in the bearing, sand particles and other debris typically remain loose and disassociated from each other in the collection space. This may allow the space to be easily and efficiently emptied by removing the bottom cap and allowing the particles to fall freely from the space.

Figure 6:
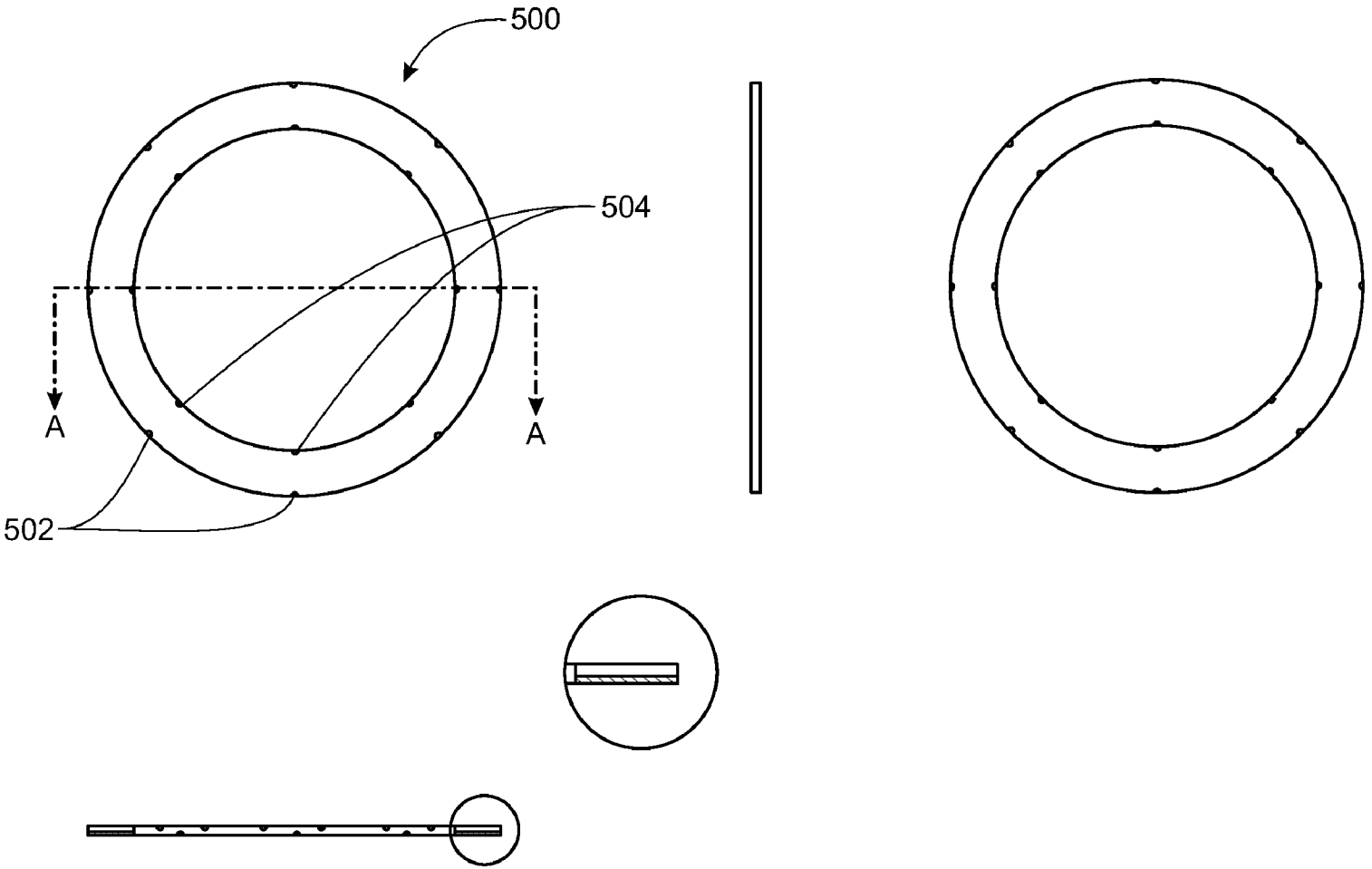
FIG. 6 provides a profile view of a bottom cap of the support shown in FIG. 2.

Bottom cap 500 may be substantially ring shaped, as shown in FIG. 6, and may include tabs 502 and 504 that allow the cap to be snapped into position with base 300. Base 300 may include, for example, slots or a lip that serve to retain the tabs on cap 500. Of course, the slots and tabs may be reversed between the components. The tabs and/or slots or lip may be of a resilient material that allows the cap to be repeatedly snapped into place. A gasket or similar may be employed between the cap and the base. This may aid, for example, in reducing intrusion of sand particles into the collection space via the joint between the cap and the base.

Figure 5:
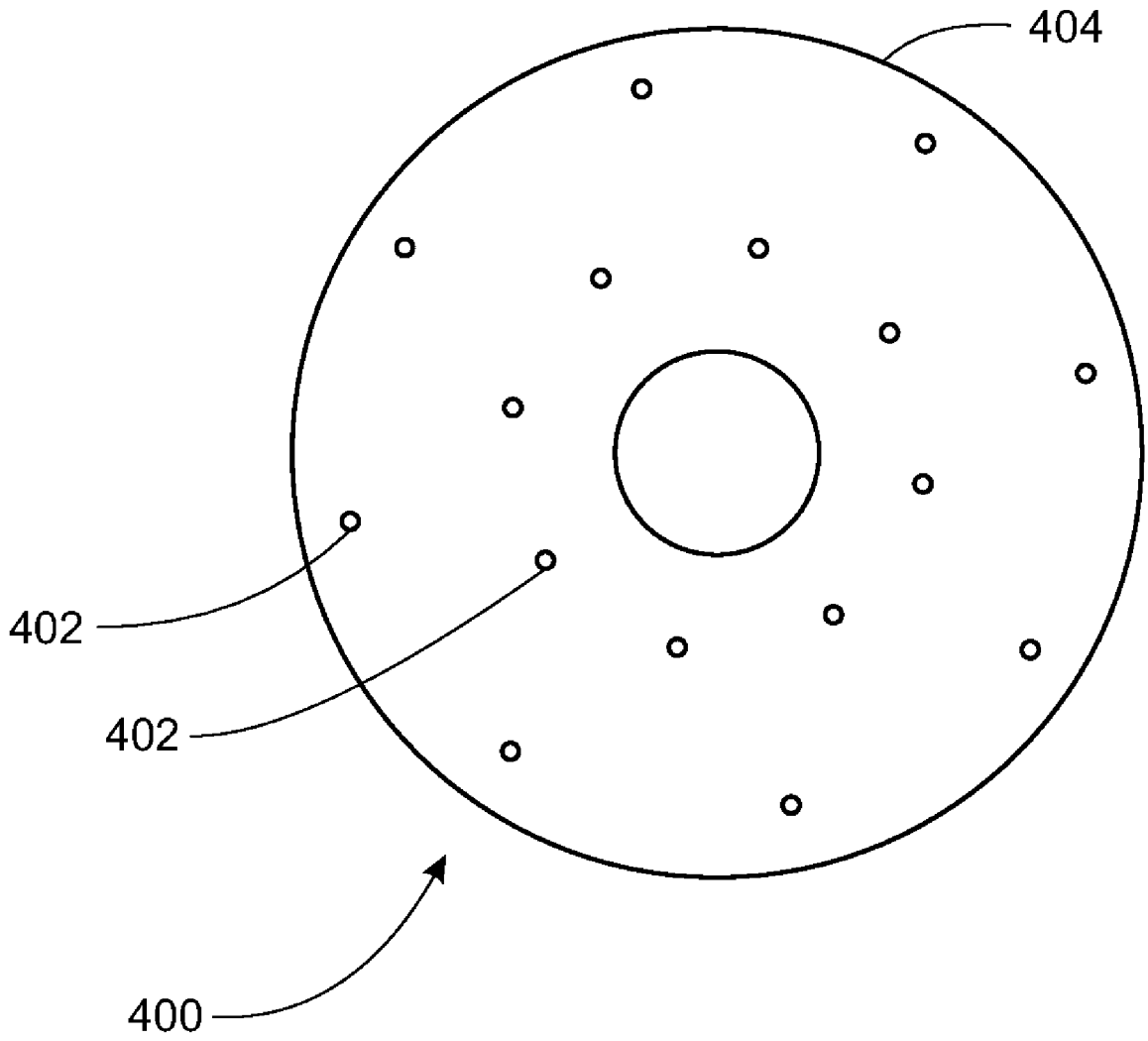
FIG. 5 provides a profile view of a clamp plate of the support shown in FIG. 2.

FIG. 5 illustrates clamp plate 400 that may be used to retain cover 200 to base 300. Clamp plate 400 may include screw holes 402 that can retain the heads of screws that pass through the clamp plate into base 300. When cover 200 and base 300 are clamped together they may rotate in relation to each other. A chair may be attached to cover 200 and may therefore rotate in relation to base 300. Clamp plate 400 may be fixed to base 300 and thus will typically not rotate with the chair. Therefore, outer edge 404 of clamp plate 400 may slide along lip 380 of cover 300 when the chair is rotated. The joint between clamp plate 400 and cover 200 may be tight, for example, to prevent the intrusion of sand but should not be so tight as to interfere with rotation of the chair. Gaskets or the like may be employed but may not be necessary and are absent in many embodiments. Any sand that might enter the bearing through this route can be expelled from the bearing into the collection space. Edge 404 may be made of a material that exhibits a low friction coefficient with the material of lip 380. A reduced amount of friction at this interface can help, for example, to reduce the resistance to rotation.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both."

All references, patents and patent applications and publications that are cited or referred to in this application are incorporated in their entirety herein by reference.

What is claimed is:

1. A rotatable chair support comprising:

a circular base having an upper surface and a lower surface, the upper surface defining a first raceway;

a cover including a second raceway complementary to the first raceway, wherein the cover further comprises a plurality of chair clips for retaining chair rails, wherein one of plurality of chair clips having a vertical U-shaped configuration and the other plurality of chair clips having two separated lateral clips extending outwardly and away from the cover and wherein the lateral clips are offset from each other;

a plurality of rolling elements retained in a space formed by the first and second raceways;

a clamp rotatably securing the cover to the base; and a cap removably attached to the lower surface of the base, the cap forming a collection cavity between the cap and the base.

2. The support of claim 1 wherein the chair clips can detachably retain the chair rails.

3. The support of claim 1 wherein the first raceway defines a series of passages to allow communication between the space and the collection cavity.

4. The support of claim 3 wherein the passages comprise a series of slits in substantial alignment with the direction of travel of the rolling elements.

5. The support of claim 4 wherein the slits are at least 1 mm in width.

6. An assembly including a chair and the support of claim 1 wherein the clips and chair rails are constructed and arranged to support the weight of the base when the chair is lifted off the ground.

7. The assembly of claim 6 wherein the support has an average diameter that is greater than 50% of the width of the chair.

8. The assembly of claim 6 wherein the support has an average diameter that is greater than 80% of the width of the chair.

9. The assembly of claim 6 wherein the first raceway is circular and has an outer diameter that is greater than 50% of the width of the chair.

10. The assembly of claim 6 wherein the first raceway is circular and has an outer diameter that is greater than 80% of the width of the chair.

11. The support of claim 1 wherein the rolling elements are balls.

12. The support of claim 11 wherein the rolling elements are comprised of polymeric material.

13. The support of claim 1 wherein the support has a height of less than 3 inches.

14. The support of claim 1 wherein the support has a height of less than 2 inches.

15. The chair support of claim 1 wherein the first raceway is raised above the lower surface of the base.

16. The chair support of claim 1 wherein the first raceway is positioned above the collection cavity.

* * * * *